United States Patent [19]

Thomas et al.

[11] Patent Number: 4,823,263

[45] Date of Patent: Apr. 18, 1989

[54] APPARATUS FOR CONTROLLING THE OPERATION OF TIPPING A MELTING CRUCIBLE

[75] Inventors: Friedrich-Werner Thomas, Gelnhausen; Jürgen Bruch, Rodenbach, both of Fed. Rep. of Germany

[73] Assignee: Leybold-Heraeus, Koln, Fed. Rep. of Germany

[21] Appl. No.: 885,455

[22] Filed: Jul. 14, 1986

[30] Foreign Application Priority Data

Jul. 12, 1985 [DE] Fed. Rep. of Germany ..... 3524858

[51] Int. Cl.[4] ..... F27B 14/20; B22D 41/00

[52] U.S. Cl. ..... 364/559; 266/240; 164/155; 164/453; 222/166; 222/591; 222/604; 364/571.05; 364/472

[58] Field of Search ..... 364/472, 477, 559, 571; 222/166, 590, 604, 591; 266/80, 240; 73/1 E; 164/4.1, 154, 155, 451, 452, 453

[56] References Cited

U.S. PATENT DOCUMENTS

| | | | |
|---|---|---|---|
| 3,917,111 | 11/1975 | Berthet et al. | 222/590 |
| 3,979,033 | 9/1976 | Fulton et al. | 222/604 |
| 3,990,614 | 11/1976 | Matsuo et al. | 222/590 |
| 4,084,631 | 4/1978 | Kunzmann | 222/590 |
| 4,105,937 | 8/1978 | Tuda et al. | 364/513 |
| 4,112,998 | 4/1978 | Sato | 222/590 |
| 4,284,214 | 8/1981 | Tate et al. | 222/590 |
| 4,445,670 | 5/1984 | Hagahi | 266/80 |
| 4,516,699 | 5/1985 | Burton et al. | 222/591 |
| 4,558,421 | 12/1985 | Shriven | 364/477 |
| 4,600,047 | 7/1986 | Matoba et al. | 164/452 X |
| 4,619,563 | 4/1986 | Bergman et al. | 222/590 |

FOREIGN PATENT DOCUMENTS

| | | |
|---|---|---|
| 41-45974 | 7/1966 | Japan . |
| 0112964 | 7/1982 | Japan . |
| 1441826 | 7/1976 | United Kingdom . |

*Primary Examiner*—P. S. Lall
*Assistant Examiner*—Joseph L. Dixon
*Attorney, Agent, or Firm*—Davis Hoxie Faithfull & Hapgood

[57] ABSTRACT

In automatic melting crucible tipping it is important that, starting from a certain angular position, the melting crucible (1) is tipped according to a predetermined model until emptying is complete. This model can be obtained, for example, by the so-called teach-in process and can be stored in an analog or digital memory (89). In order to prevent abrupt movement of the crucible (1) when the molten material touches the pouring lip (3) of the crucible (1) when the pour-lip angle has been reached, according to the invention a correction arrangement (108, 109, 37) is provided which enables the tipping process to proceed continuously and without abrupt movements even in the case of different pour-lip angles.

16 Claims, 5 Drawing Sheets

Teach-In
Gießen
$K_T$
$-K_G$
$\frac{C \cdot D}{10V}$
$\frac{A}{B} \cdot 10V$
$\left(\frac{W_{PL}-W_{St}}{W_E-W_{St}}(W_E-W)\right)$
$\frac{W_{PL}-W_{St}}{W_E-W_{St}}$
$\left(\frac{W_{PL}-W_{St}}{W_E-W_{St}}\right)$
$\frac{W_{PL}-W_{St}}{W_E-W_{St}}(W-W_E)$
$(W_E-W)$
$W_E-W_{PL}$
$(W_E-W_{St})$
$(W_{PL}-W_{St})$
$W_G$
$W_H$
$-W_E$ (115°)
$-10V$
$W_{St}$
$W_{PL}$
$W_H$
$W_{PL}$ (30°)
$K_{St}$
$+10°$
$-10°$
$W_E$
$W_{St}-W_{PL}$
10°
20°
30°
40°
50°
60°
70°
80°
90°
100°
110°
W
510
511
512
513
601
602
603
604
605
606
607
620
621
622
623
624
626
627
628
629
630
631
632
633
634
650
651
652
653

APPARATUS FOR CONTROLLING THE OPERATION OF TIPPING A MELTING CRUCIBLE

BACKGROUND OF THE INVENTION

1. Field of the Invention

The present invention relates to an apparatus for controlling the operation of tipping a melting crucible, having a pouring curve that is stored in a memory, which controls the pouring operation, at least from the beginning of pouring out, when the melting crucible assumes the pour-lip angle $\alpha_{PL}$, until the melting crucible has been completely emptied, in accordance with a function $\alpha=f(t)$ which is referred to certain geometric conditions of the melting crucible and/or of the molten material and in which $\alpha$ represents the tipping angle of the melting crucible and t represents time.

2. Background Information

In the manufacture of precision cast articles it is necessary for the pouring operation to take place within a very short time in order that all the liquid molten material in the mold be subjected to the solidification process as simultaneously as possible. If pouring is carried out too slowly, the molten material first poured into the mold will alread have cooled and solidified by the time that the molten material poured later reaches the mold. Articles cast in this manner do not meet the desired values from the point of view of strength.

In order to ensure that the molten material is poured out of a crucible and into a mold in a rapid and reproducible manner, the pouring operation must be automatically controlled. The so-called "teach-in" method is particularly advantageous. In this method, for example, various test pouring operations are carried out and the respective pouring curves, that is to say the curves representing the tipping angle of the crucible as a function of time, are stored directly in memories. That pouring curve which produces the best pouring result is used as a model for subsequent pouring operations. The memory containing the optimum pouring curve is thus the "master" memory for all future pouring operations. The memory automatically controls the pouring operation from beginning to end and in this manner ensures its reproducibility from charge to charge.

The actual operation of pouring out the molten material generally begins only at a crucible tipping angle of approximately 30° when the molten material just touches the pouring lip of the crucible burt does not yet run out. The end point of the pouring-out operation is dependent upon the apparatus and is, for example, 115°. Between these two angular positions of the crucible, automatic pouring-out takes place by means of the teach-in method.

SUMMARY OF THE INVENTION

If the geometry of the crucible were invariable and if the same quantity of material to be melted were always introduced into the crucible, the pouring operation could always begin when the crucible was exactly in the 30° position. In practice, however, the molten material does not always touch the pouring lip of the crucible at a position of 30° either becuase the geometry of the crucible has been altered through refractory loss or becuase the amount of material to be melted that is supplied is not always the same. The resulting deviations from the angular position of 30° in practice vary a maximum of ±10°.

The material is always melted at an angular position of 0°. If pouring-out by means of teach-in is initiated at 30°, then, in accordance with the level of the melt bath, the crucible must, for the above reasons, be brought into the appropriate pouring-out position of 30°±10°. This movement is either carried out manually by the operator observing the height of the melt or by automatic control by means of a level measuring device.

If, under these conditions, the crucible is tipped to such an extent that the molten material touches the pouring lip of the crucible, the tipping angle may sometimes be more than 30° and sometimes less. If, in this position, the automatic pouring-out operation by means of the teach-in method is then initiated, unless a suitable correction is made, the crucible will first be brought into the stored starting position and will then be tipped in accordance with the instructions of the master memory until the pouring operation is complete.

Since the drive means for tipping a crucible exert large forces, the crucible is moved jerkily from the position in which the molten material touches the pouring lip of the crucible to the stored starting position. As a result of this jerky movement, the molten material can splash out of the crucible and cause damage. This jerky behavior will therefore always occur in the case where the pour-lip position stored by means of the teach-in method differs from the position actually set manually or by means of an optical level measuring device.

The problem underlying the invention is, therefore, to provide a correction apparatus which prevents these abrupt movements in a control device for a melting crucible that, starting from a certain angular position, automatically tips the melting crucible in accordance with a predetermined model until emptying is complete.

This problem is solved by a correction circuit which, taking into account an altered pour-lip angle $\alpha'_{PL}$, converts the continuous function $\alpha=f(t)$ into a corrected continuous function $\alpha'=f_1(t)$ that, at the beginning of the pouring operation at point in time $t_A$, has a tipping angle $\alpha'_{PL}$ that differs from tipping angle $\alpha P_L$ and, at the end of the pouring operation at point in time $t_E$, has a tipping angle $\alpha'$ that is identical to the tipping angle $\alpha$ at point in time $t_E$.

The advantage obtained by the invention lies particularly in the fact that the advantages of automatic pouring can be utilized also in the case where the tipping angle at which the pouring lip is in contact with the melt varies from charge to charge by a maximum of ±10°.

The invention can be used both in the case of automatic control starting from a 30° position of the crucible and in the case of automatic control staring from any other angles of the crucible. An embodiment of the invention is shown in the drawings and is described in detail below.

DETAILED DESCRIPTION

Figure 1:
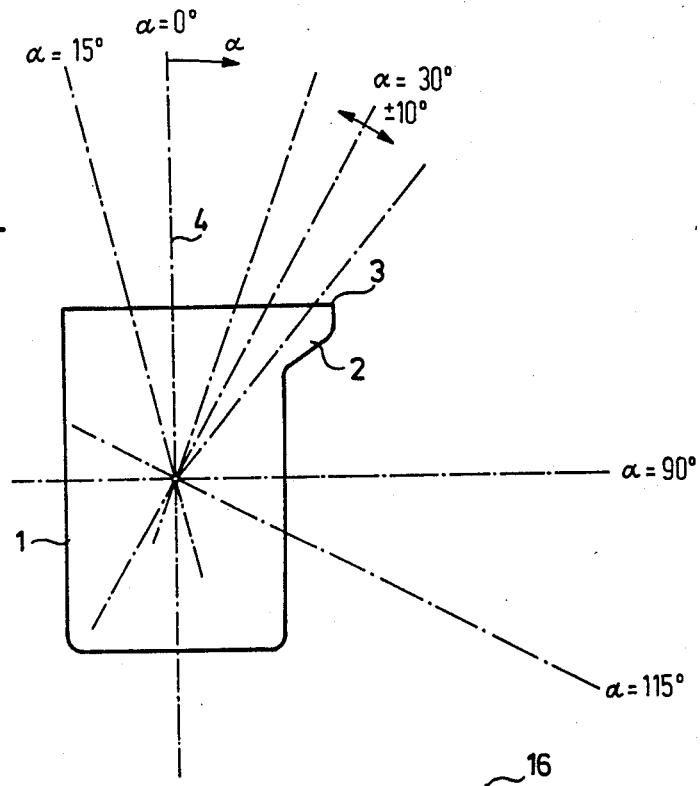
FIG. 1 shows a pouring crucible having various angular positions of the vertical crucible axis indicated.

FIG. 1 shows a crucible 1 of an induction furnace having a pouring spout 2 with a pouring lip 3. The vertical axis of this crucible 1 has the reference numeral 4. This vertical axis corresponds to the tipping angle $\alpha=0°$. In the position $\alpha=0°$, melting or charging can take place. The necessary process measurements are also carried out in this position. While shown centrally in FIG. 1, in practice, the tipping axis is in the vicinity of the pouring lip.

If the crucible 1 is tipped, for example, by manual control in the counter-clockwise direction, it finally assumes the angle $\alpha=-15°$. In this position, the necessary slag manipulation can be carried out.

When the crucible 1 is tipped in the clockwise direction, after a certain time its longitudinal axis 4 assumes the position $\alpha_{PL}=30°$ in which, in normal cases, the pouring operation is initiated. It is desirable at $\alpha=30°$ for the molten material just to touch the pouring lip but not to run out, and when this ideal condition exists, $\alpha=30°=\alpha_{PL}$, the angle at which pouring out just begins. This ideal condition does not apply to every pouring operation, however, because the level of the molten material in the crucible 1 can vary as a result of raw material ingots of different sizes being introduced into the crucible 1 for melting or as a reuslt of crucible refractory losses. In practice, deviations in the so-called "pour-lip angle" $\alpha_{PL}$, otherwise referred to as the ideal initial pour point angle $\alpha_{PL}$, of $\pm10°$ occur.

The actual tipping-out or pouring-out operation takes place when the axis 4 of the crucible 1 is in a position between 30° and 115°.

After pouring-out, the crucible 1 can, if necessary, be moved into a position $\alpha=90°$ for the purpose of replacement or recharging of the crucible.

The angular position of the crucible axis that is of importance to the present invention is the 30° position which applies at the beginning of the pouring operation. As already mentioned, this position is stored in a memory, preferably a digital memory, which controls the further course of the pouring operation in accordance with the programmed optimum curve defined by the equation $\alpha=f(t)$. By operation of a button or some other switching means, the information stored in the memory is called up and converted into crucible positions.

If the level of the molten material in the crucible is higher than it was in the case of the programmed ideal pouring operation and the crucible 1 is moved, either manually by the operator or automatically by means of an optical level measuring device, into that position in which the molten material is just touching the pouring lip 3, then the associated angle will be less than 30°, for example only 20°. If the operator were then to press the button that initiates the automatic pouring operation, the crucible drive means would move the crucible 1 from the 20° position into the 30° position with a jerk, so that large amounts of the molten material would splash out of the crucible 1. If the level in the crucible 1 is lower than in the case of the ideal pouring operation, in the 30° position, the molten material will still not touch the pouring lip 3. The operator or the automatic level measuring device will therefore tip the crucible 1 further until the molten material touches the pouring lip 3, for example, to an angle of $\alpha=40°$. If the operator now presses the button initiating the automatic pouring operation, the crucible 1 will be tipped jerkily back to the 30° position. From that point, the pouring operation will begin, however, nothing at all will be poured in the first instance because the molten material must first reach the pouring lip 3 again. When the molten material finally reaches the pouring lip, it will be poured out at a rate that does not correspond to the ideal rate.

In order to retain the advantage of automatic crucible tipping by means of the teach-in method even when the angle at which the molten material touches the pouring lip 3 of the crucible 1 is not constant but deviates around a certain value, according to the invention, a special correction of the tipping angle function is carried out. Some corrected tipping angle functions are shown in FIG. 2 in which the tipping angles are each entered over time.

Figure 2:
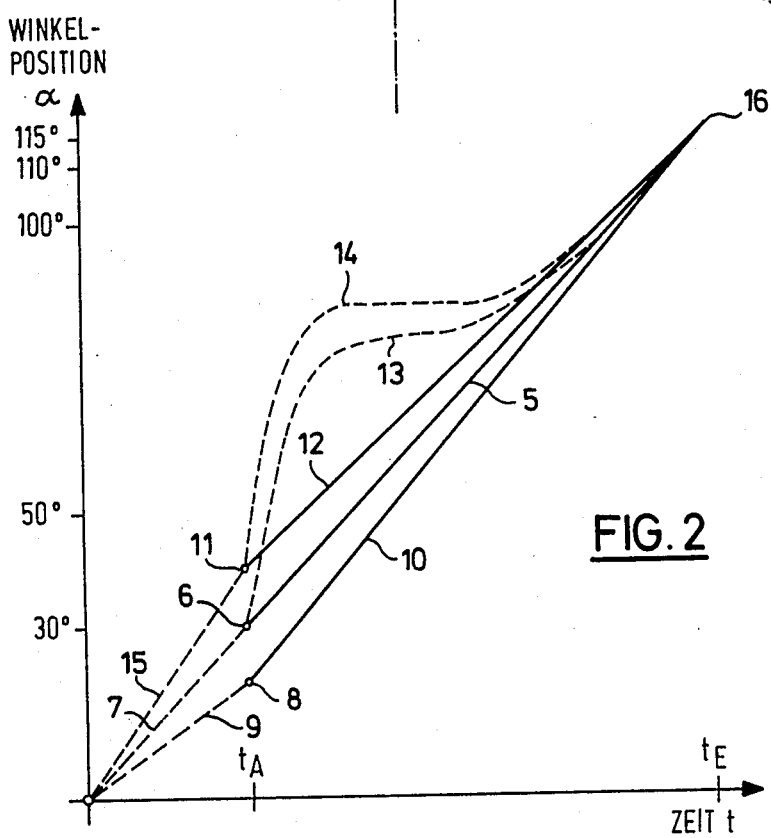
FIG. 2 shows the tipping angle of the crucible in dependence upon time t in various tipping oeprations over the same tipping period.

In FIG. 2, the straight line 5, which represents the automatic pouring operation, exhibits a linear connection between the tipping angle and time, that is to say the crucible 1 is tipped by the same angular amounts per unit time interval. At a point in time $t_E$, the automatic pouring operation is over. The straight line 5 begins at point 6 where the crucible is already at an angle $\alpha_{PL}$ of 30°. Point 6 therefore marks the condition in which the molten material exactly touches the pouring lip 3. The dotted line 7 indicates the area of manual control or automatic control by means of an optical level measuring device in the case where the level of the molten material is ideal. If the level of the molten material in the crucible 1 is higher than it should be, it reaches the pouring lip at less than 30°, for example at 20° at point 8. The area of manual control or control by means of an optical level measuring device is here indicated by the straight line 9. In order that in this case too the automatic pouring operation ends at point in time $t_E$, the automatic pouring must be carried out more quckly, for which reason the gradient of the straight line 10 is steeper than the gradient of straight line 5. The reverse conditions apply when the level of the molten material in the crucible 1 lies below the ideal value. In this case the crucible 1 must be tipped, for example, until it reaches the 40° position 11 in order that the molten material touches the pouring lip 3. If, here too, the automatic pouring operation is to end at time $t_E$, pouring must be carried out more slowly and this is reflected by the shallower gradient of the straight line 12.

The ideal pouring curve need not be a straight line 5 but may be a non-linear curve 13 which is shown by a dotted line in FIG. 2. In this case the curve 14, which is also shown by a dotted line, represents the associated non-linear, corrected curve which, in the case of a molten material level that is too low, ensures the same pouring period $t_E - t_A$ as in the case where the molten material level is ideal.

According to the invention, from a desired position value on the ideal puring curve there is derived a correction value which corrects the ideal desired position value in such a manner that, depending upon the position, the corrected curves 10 and 12 are produced from the uncorrected ideal curve 5.

Figure 3:
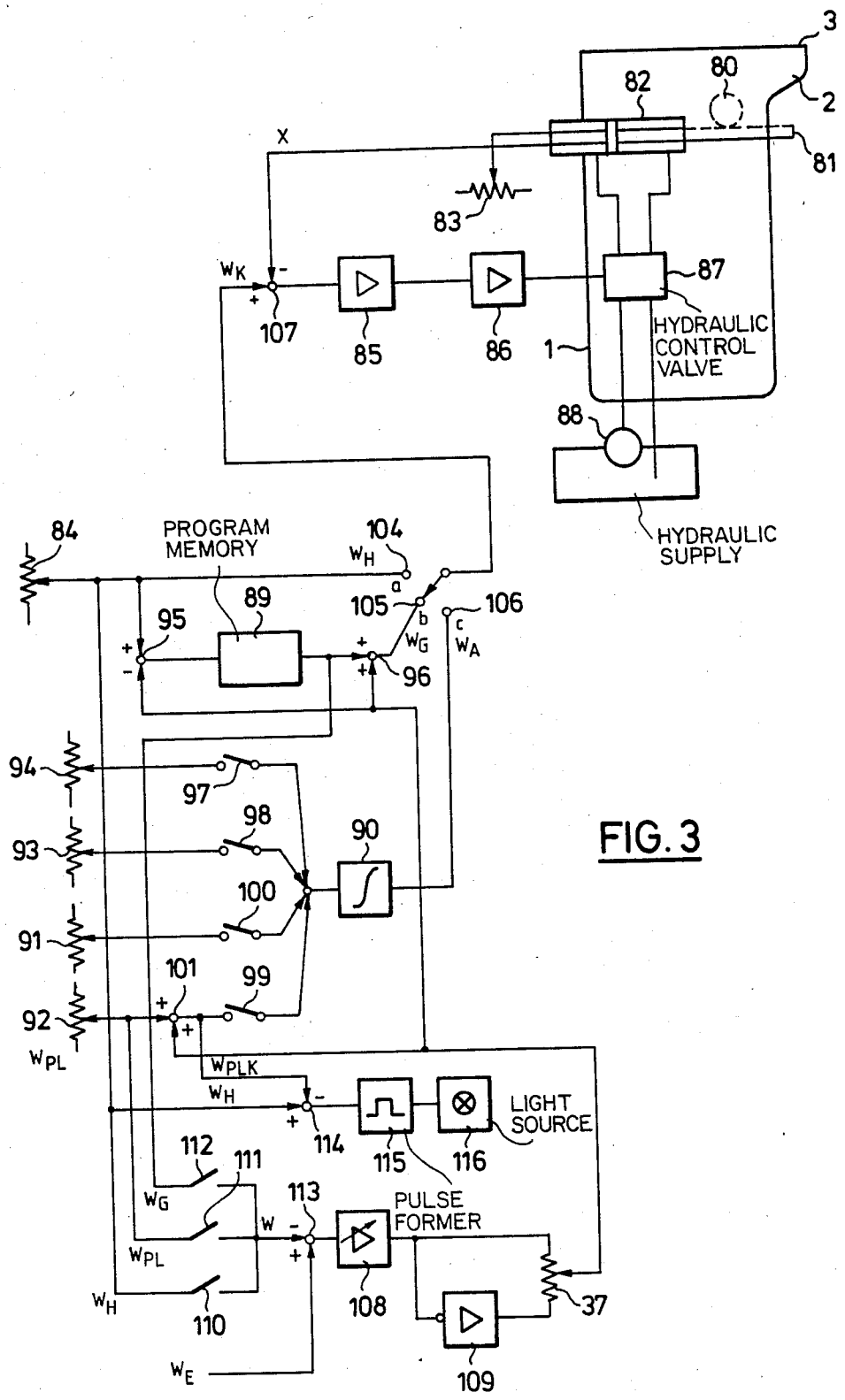
FIG. 3 is a diagram showing the principle underlying the automatic crucible tipping device with manual correction of the pour-lip position.

In FIG. 3, the use of the invention in automatic crucible tipping with correction is shown by a basic block diagram. This again shows the crucible 1 with the pouring spout 2 and the pouring lip 3. The crucible 1 is pivotally arranged and can be pivoted in the clockwise and counter-clockwise directions by turning a toothed wheel 80 connected to the crucible. The toothed wheel 80 engages a toothed rack 81 which can be operated, for example, by a hydraulic operating cylinder 82. To this cylinder 82 there is connected an actual position value transmitter 83 which converts the actual positions of the crucible 1 into electrical signals. A hydraulic control valve 87 is actuated by a position regulator 85 via a servo-amplifier 86. The control valve 87 effects a greater or lesser flow of a hydraulic medium from a hydraulic supply 88 to the operating cylinder 82. It should be mentioned here that any other control element, for example, drive means, magnets, etc., may of course, be used. The position regulator 85 is supplied with both the actual position value of the actual position value transmitter 83 and, by way of a summing point 107, a value that is present at one of the terminals 104, 105, 106 of an operation selector switch. At termianl 104 there is present the manual desired position value which is picked up at resistor 84. Terminal 105 is supplied with a signal that is formed by the summing point 96. This summing point 96 receives a signal from a program memory 89 and from the correction potentiometer 37. Terminal 106 receives a signal from an integrator 90 of which the input can be connected selectively to various desired value transmitters via switches 97–100. The desired value "tipping position: −15°" which is picked up at a resistor 94 is passed via the switch 97 to the integrator. In corresponding manner, the desired value "tipping position: 0°" from a different desired value transmitter 93 is passed via switch 98 to the integrator 90. The same applies to the tipping positions "30°" and "90°" which come from the desired value transmitters 92, 91 and can be supplied to the integrator 90 by way of switches 99, 100.

The correction signal, which is picked up at potentiometer 37, is generated by the amplifier circuits 108, 109 to which the "115°" desired value $W_E$ is supplied by way of summing point 113 and, selectively, the manual desired position value $W_H$ is supplied via switch 110, the "30°" desired value is supplied via switch 111 and the desired value from the teach-in program memory is supplied via switch 112.

From the potentiometer 37, the correction value also passes to a summing point 101 which is located between the switch 99 and the resistor 92. The circuit portion 114, 115, 116 serves for the optical indication that the correction function has been set correctly.

Using the operation selector switch, which can be located in positions 104, 105 and 106, it is possible to select different types of operation. In position 104, control solely by hand is possible. On the other hand, in position 105 the automatic tipping operation is caried out according to the instructions of the program memory 89, with the ±10° correction according to the invention. In position 106, automatic tipping to fixed positions takes place.

Figure 4A:
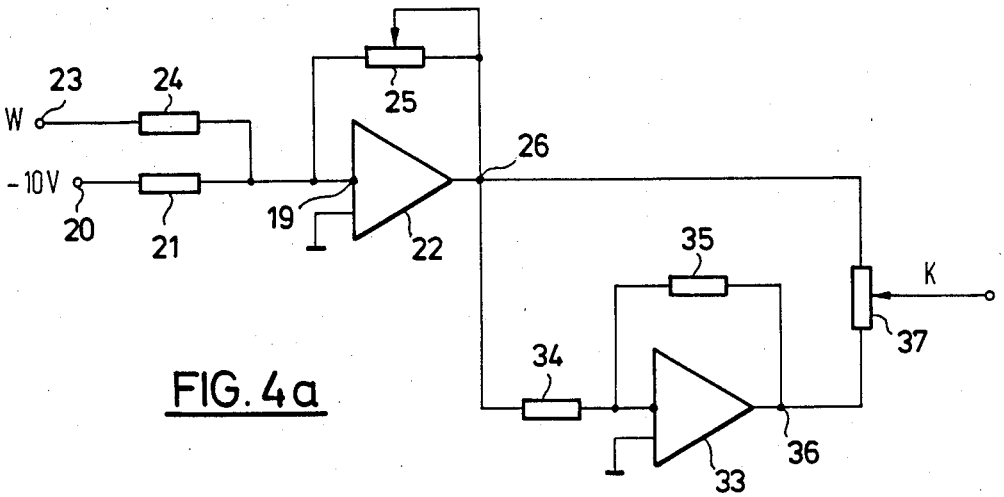
FIG. 4*a* shows an analog circuit arrangement for the manual setting of a correction function for a predetermined pouring function $\alpha=f(t)$, automatic control of the crucible staring from the position $\alpha'_{PL}=30°\pm10°$.

FIG. 4*a* shows a detailed view of the correction circuit 108, 109, 113 according to FIG. 3. Of course, as an alternative, digital corrections withs the aid of a computer or the like are also possible.

Figure 4B:
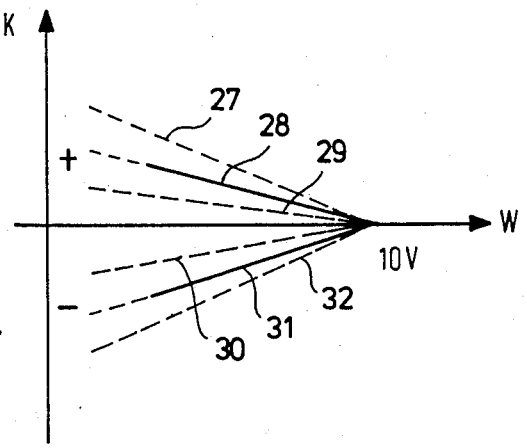
FIG. 4*b* shows various characteristic curves of correction values K in dependence upon the desired position value W that can be produced using a circuit arrangement according to FIG. 4*a*.

The family of characteristic curves belonging to the circuit arrangement according to FIG. 4*a* is shown in FIG. 4*b*.

The end position of the crucible at 115° is defined, for example, by −10 V at point 20 in FIG. 4*a*. This −10 V is supplied via a resistor 21 to an input 19 of an amplifier 22. The desired crucible position value W that is present at point 23 passes, likewise via a resistor 24, to the input 19 of the amplifier 22. The inverting amplifier 22 with the adjustable feedback resistor 25 supplies at its output the negative sum of the voltage present at points 20 and 23, multiplied by the amplification factor given by the resistors 21, 24 and 25.

In order to be able to input the correction characteristic curves for both polarities, there is provided a reversing amplifier 33 of which the input is connected by way of a resistor 34 to the output 26 of the amplifier 22 and which has a feedback resistor 35. Between the outputs 26, 36 of the two amplifiers 22, 33 there is arranged a potentiometer 37 with which various correction characteristic curves according to FIG. 4*b* can be set.

FIG. 4*b* gives the correction values K which are present at the tap of the potentiometer 37 in dependence uon the ideal desired position value. These correction values K, in addition to being dependent on the desired position value W, are also dependent on the particular amplification value of the amplifier 22 that has been set and on the setting of the correction potentiometer 37. Each individual characteristic curve 27–32 is therefore assigned to a certain setting of the potentiometer 37.

The correction circuit is so designed that, in the case of a desired value W of 30°, a voltage that corresponds to an angle of +10° is present at the output of the amplifier 22. At the output of the inverter 33 there is therefore present a voltage that corresponds to −10°. These two values lie on either side of the potentiometer 37, so that in the case of a desired value W of 30° the correction value K can be set at between +10° and −10°. When the desired value nears the end position 115° (=10 V), the output voltage of the amplifier 22 approaches 0, that is to say that the correction set becomes less and less effective and on reaching the end position the corrected curve and the original curve are identical (see curves 5, 10, 12 in FIG. 2).

In the case of the teach-in process, the correction function is considered in such a manner that a standardized pouring curve is stored in the program memory, that is to say a pouring curve that begins exactly at 30°. For this purpose, the correction value K is subtracted from the manual desired value $W_H$ at summing point 95. During the pouring operation, the correction signal K is added to the standardized pouring curve issued by the program memory at summing point 96.

In practice the correction setting can be made, for example, by the operator tipping the crucible 1 manually by way of the optentiometer 84 to such an extent that the melt just touches the pouring lip 3. The correction potentiometer 37 is displaced until the display 16 indicates the correct setting. The automatic pouring process can then be initiated, a smooth transition from hand operation to automatic pouring being ensured by the correction circuit.

Figure 5:
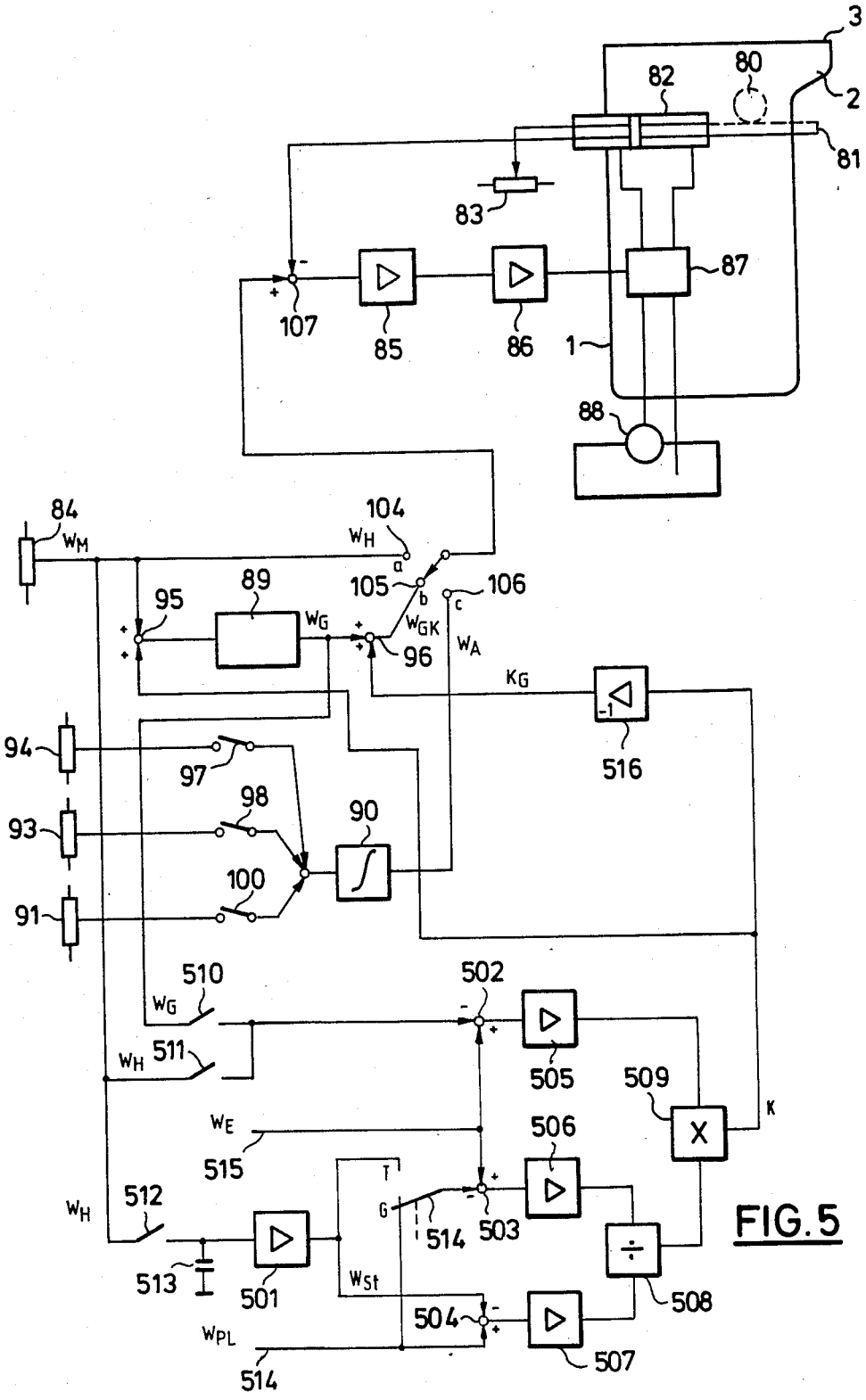
FIG. 5 is a diagram showing the principle underlying the automatic crucible tipping device with automatic correction of the pour-lip position.

FIG. 5 shows a basic block diagram illustrating the use of the invention in automatic crucible tipping. Only the part of FIG. 5 that differs from FIG. 3 will be explained below.

At the beginning of the teach-in operation or the pouring operation, the switch 512 is opened and the manual desired value that is present at this time, corresponding to the actual pour-lip position $\alpha'_{PL}$, otherwise referred to as the actual initial pour point angle $\alpha'$PL, is stored in an analog memory 513, 501. From the difference between this value and the exact pour-lip value 30°, from the end value $W_E$(115°) and from the current desired value $W_G$ or $W_H$ there is formed a suitable correction function in the analog computer circuit 502 to 509.

Figure 6C:
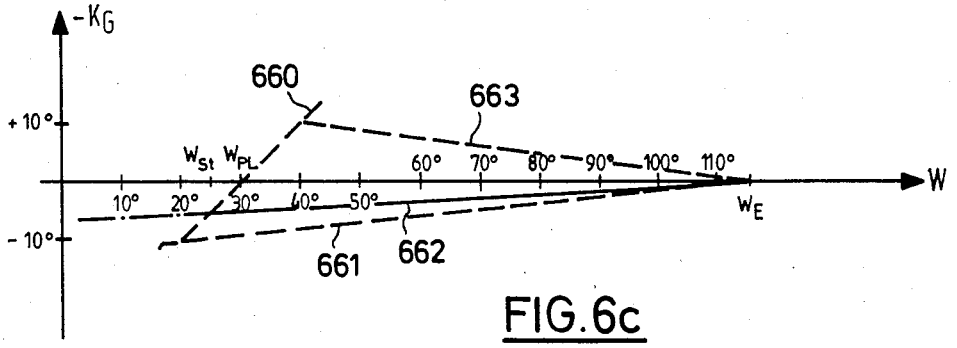
FIG. 6*c* shows a family of characteristic curves belonging to the circuit arrangement according to FIG. 6*a* for the pouring operation.
Figures 6A, 6B:
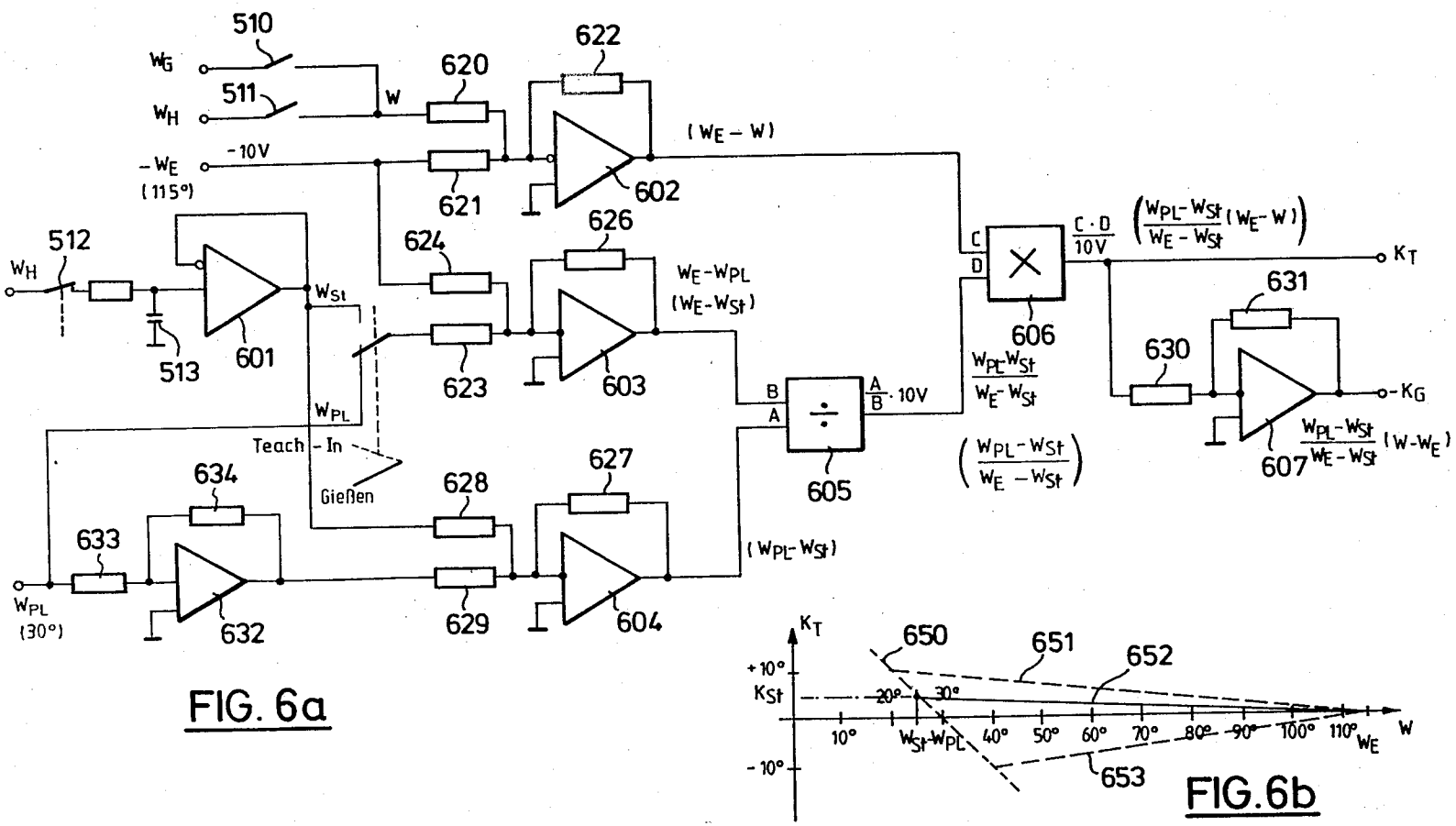
FIG. 6*a* shows an analog circuit arrangement for automatic generation of a correction function for a predetermined pouring function $\alpha=f(t)$, the automatic control of the crucible starting from the position $\alpha'_{PL}=30°\pm10°$.
FIG. 6*b* shows a family of characteristic curves belonging to the circuit arrangement according to FIG. 6*a* for the teach-in process.

FIG. 6a shows the correction circuit shonw in block form in FIG. 5 in greater detail. Of course, as an alternative, digital corrections using a computer or the like are also possible.

The family of characteristic curves belonging to the circuit in FIG. 6a is shown in FIG. 6b for the teach-in process and in FIG. 6c for the pouring operation.

The manual desired value $W_H$ is present at the output of the amplifier 601 as long as the switch 512 is closed. If, at the beginning of the pouring operation or the teach-in operation, the switch 512 is opened, the manual desired value $W_H$ last present is stored as the starting value $W_{St}$. This will always correspond to the particular pour-lip position $\alpha'_{PL}$. The amplifier 604 forms the difference between the exact pour-lip value $W_{PL}$ and the starting value $W_{St}$. The amplifier 603 forms the difference between the end value $W_E$ and the starting value $W_{St}$ in the case of the teach-in operation and the difference between the end value $W_E$ and the exact pour-lip value $W_{PL}$ in the case of the pouring operation. At the output of the divider 605 there is present the quotient obtained from the differences $(W_{PL}-W_{St})/(W_E-W_{PL})$ in the case of the pouring operation and $(W_{PL}-W_{St})/(W_E-W_{St})$ in the case of the teach-in operation. The quotient, together with the difference between the end value $W_E$ and the current desired value W, which is formed by the amplifier 602, is multiplied by the building block 606. As the current desired value W there is selected the program desired value $W_G$ using switch 510 in the case of pouring and the manual desired value $W_H$ using switch 511 in the case of teach-in. The different correction functions are made possible by the change-over switch 514. In the case of teach-in, the generated correction $K_T$ is added to the manual desired value at summing point 95 in order to obtain the standard curve necessary for storing; in the case of pouring, the generated correction $K_G$ is added to the program desired value in order to obtain the current pouring curve from the standard curve. The relationships given in brackets in FIG. 6a apply when the change-over switch 514 is in the teach-in position.

We claim:

1. An apparatus for controlling the tipping of a melting crucible for pouring molten material, comprising:

a control means for controlling the tipping of the melting crucible;

a memory connected to the control means, said memory storing an ideal pouring control curve for controlling the tipping of the melting crucible;

said control means, under ideal conditions, being responsive to the ideal pouring control curve to control the tipping of the melting crucible from at least an ideal initial pour point angle $\alpha$PL when the material begins to pour out of the crucible, and continuing to control the tipping of the melting crucible until the melting crucible has been completely emptied at which point the melting crucible is tipped at an ideal end pour point angle $\alpha$E;

said ideal pouring control curve being a continuous function $\alpha=f(t)$ in which $\alpha$ represents the tipping angle of the melting crucible and t represents time; and a correction circuit for converting the continuous function $\alpha=f(t)$ for control of pouring under ideal conditions into a corrected continuous function $\alpha'=f_1(t)$ for control of pouring under actual conditions, said correction circuit taking into account an actual initial pour point angle $\alpha'$PL and deriving the corrected function $\alpha'=f_1(t)$ based on the difference between $\alpha$PL and $\alpha'$PL, said corrected continuous function having the actual initial pour point angle $\alpha'$PL, at a point in time $t_A$, and, at the end of the crucible pouring operation at a point in time $t_E$, at which said corrected function has an actual end of pouring angle $\alpha'$E which is identical to the ideal end of pouring angle $\alpha$E.

2. An apparatus according to claim 1, in which the melting crucible is manually tipped from a tipping angle of $\alpha=0°$ to the actual initial pour point angle $\alpha'$PL and the control means only automatically controls tipping of the melting crucible from $\alpha'$PL to $\alpha'$E.

3. An apparatus according to claim 1, in which the control means automatically controls the tipping of the melting crucible from a tipping angle of $\alpha=0°$ to the actual initial pour point angle $\alpha'$PL.

4. An apparatus according to claim 1, 2, or 3, in which $\alpha=f(t)$ and $\alpha'=f_1(t)$ are linear functions.

5. An apparatus according to claim 1, in which the correction circuit is of analog construction.

6. An apparatus according to claim 1, comprising a pouring curve stored in the memory (89) obtained according to a teach-in process.

7. An apparatus according to claim 6, in which a pouring operation is carried out manually from a starting position selected from the group consisting of $\alpha=0°$ and $\alpha=\alpha$PL, and the angular positions passed through are digitalized on a fixed time grid and stored in a digital memory.

8. An apparatus according to claim 1, in which:

the correction circuit comprises a regulatable amplifier which is supplied both with a first electrical magnitude corresponding to the end position of the melting crucible at the point in time $t_E$ and with a second electrical magnitude corresponding to the continuous desired value of the curve $\alpha=f(t)$;

the output of the amplifier is connected to a resistor having a correction tapping point;

the output signal of the amplifier is supplied to the input of an inverter;

the output of the inverter is also present at the resistor; and the tapped value from the connection tapping point forms a correction signal.

9. An apparatus according to claim 8 in which the actual initial pour point angle $\alpha'$PL indicative of the position of the melting crucible before pouring begins is stored in the memory and the correction signal is obtained automatically from the difference between the ideal value of $\alpha$PL in the pouring curve stored in the memory and the actual value of $\alpha'$PL by means of a computer circuit.

10. An apparatus according to claim 1, in which manually operable desired value transmitters are provided, wherein:

on operation of the first desired value transmitter the melting crucible is moved into position $\alpha = -15°$;

on operation of the second desired value transmitter the melting crucible is moved into position $\alpha = 0°$;

on operation of the third desired value transmitter the melting crucible is moved into position $\alpha = 90°$; and on operation of the fourth desired value transmitter the melting crucible is moved into position $\alpha = 30°$.

11. An apparatus according to claim 1, comprising an operation selector switch which allows setting to either manually-controlled tipping or corrected-program-controlled tipping of the melting crucible.

12. An apparatus according to any one of claims 1–3, 5–11 wherein said control means further comprises an actual position value transmitter which emits an actual position value which is subtracted from a desired position value and is supplied to a PID regulator which controls a hydraulic valve that influences a hydraulic supply to an operating cylinder which is connected to a toothed rack that tips the melting crucible by means of a toothed wheel.

13. An apparatus according to claim 8, in which the desired position value is either a manual desired value, or a pouring desired value, or an automatic desired value.

14. An apparatus according to claim 1, comprising a memory in which there are stored a plurality of ideal pouring control curves for several ideal initial pour point angles $\alpha$PL, means for automatically detecting the actual initial pour point angle $\alpha'$PL, and means for calling up the stored ideal pouring curve assigned to that angle.

15. An apparatus according to claim 1, 2 or 3 in which $\alpha = f(t)$ and $\alpha' = f_1(t)$ are non-linear functions.

16. An apparatus according to claim 1 in which the correction circuit is of digital construction.

* * * * *

UNITED STATES PATENT AND TRADEMARK OFFICE

CERTIFICATE OF CORRECTION

PATENT NO. : 4,823,263

DATED : April 18, 1989

INVENTOR(S) : Thomas, Friedrich-Werner, et al.

It is certified that error appears in the above-identified patent and that said Letters Patent is hereby corrected as shown below:

At column 1, line 27, "alread" should read --already--;
At column 1, line 65, "becuase" should read --because--;
At column 2, line 55, "staring" should read --starting--;
At column 2, line 64, "oeprations" should read --operations--;
At column 3, line 4, "staring" should read -- starting--;
At column 5, line 8, "puring" should read --pouring--;
At column 5, line 35, "termianl" should read --terminal--;
At column 6, line 2, "caried" should read --carried--;
At column 6, line 9, "tap" should read -- top --;
At column 6, line 33, "withs" should read --with--;
At column 6, line 34, "uon" should read --upon--;
At column 6, line 50, "(= 10 V)" should read --(≙ 10 V)--;
At column 6, line 66, "optentiometer" should read --potentiometer--;
At column 7, line 20, "shonw" should read --shown--.

Signed and Sealed this

Thirty-first Day of July, 1990

*Attest:*

HARRY F. MANBECK, JR.

*Attesting Officer*

*Commissioner of Patents and Trademarks*